US005618645A

United States Patent [19]

Nakano et al.

[11] Patent Number: 5,618,645

[45] Date of Patent: Apr. 8, 1997

[54] ELECTROPHOTOGRAPHIC PRINTING PLATE PRECURSOR

[75] Inventors: Junji Nakano; Nobuo Suganuma; Hiromichi Tachikawa, all of Shizuoka, Japan

[73] Assignee: Fuji Photo Film Co., Ltd., Ashigara, Japan

[21] Appl. No.: 405,784

[22] Filed: Mar. 17, 1995

[30] Foreign Application Priority Data

Apr. 12, 1994 [JP] Japan ..... 6-073478

[51] Int. Cl.$^6$ ..... G03G 5/00; G03G 13/28

[52] U.S. Cl. ..... 430/56; 430/49

[58] Field of Search ..... 430/49, 56

[56] References Cited

U.S. PATENT DOCUMENTS 5,063,126 11/1991 Yokoya et al. ..... 430/49
5,073,464 12/1991 Osawa et al. ..... 430/49

FOREIGN PATENT DOCUMENTS 4-304464 10/1992 Japan .

OTHER PUBLICATIONS

CA 119:59773 of Japanese Patent 43–04464 (Pub Oct. 1992).

Patent & Trademark Office English–Language Translation of Japanese Patent 4–304464 (Pub Oct. 1992).

Lewis, Richard, J. *Hawley's Condensed Chemical Dictionary*, 12ed Van Nostrand Reinhold Co, NY (1993) pp. 963–964.

Grant et al, ed. *Grant & Hackh's Chemical Dictionary*, 5th ed McGraw–Hill Book Co., NY (1987) pp. 443–444.

*Primary Examiner*—Janis L. Dote

*Attorney, Agent, or Firm*—Burns, Doane, Swecker & Mathis, LLP

[57] ABSTRACT

An electrophotographic printing plate precursor is disclosed, which is formed by forming a toner image on a photoconductive layer of an electrophotographic photoreceptor comprising at least a conductive support and a photoconductive layer and then by removing a non-image area on the photoconductive layer other than a toner-image area, wherein said photoconductive layer comprises at least (1) an organic photoconductive compound, (2) a binder resin which is dissolved or swelled in an alkaline solution, and (3) a phosphoric acid or an analogue thereof.

3 Claims, No Drawings

ELECTROPHOTOGRAPHIC PRINTING PLATE PRECURSOR

FIELD OF THE INVENTION

The present invention relates to an electrophotographic printing plate precursor, which is obtained by forming toner images on a photoconductive layer and removing the non-image area of photoconductive layer. In particular, it is concerned with an electrophotographic printing plate precursor, which has a high elution speed, is prevented from generating scum upon printing and provides a lithographic printing plate (i.e., a planographic printing plate) of high image quality.

BACKGROUND OF THE INVENTION

Nowadays presensitized plates (i.e., PS plates) using, e.g., a positive-type photosensitive material which contains a diazo compound and a phenol resin as main components and a negative-type photosensitive material which contains an acrylic monomer or prepolymer as a main component, are used in practice as lithographic offset printing plates. These plates are all low in sensitivity, and so in the exposure operation for producing therefrom the printing plates it is required of them to be in close contact with an original film on which images are previously recorded. On the other hand, owing to progress in both computer technology, including graphic processing and bulk data storage, and data communication technology, there has lately been put to practical use an electronic editing system in which a series of operations, involving input of originals, amendment, compilation, layout and page make-up, are performed from first to last with a computer and the thus edited originals are transmitted immediately as the output to remote terminal plotters by a high-speed communication network or communications satellite. In particular, there is a great demand for the electronic editing system in the field of newspaper printing which requires the immediacy. Further, in a field such that original manuscripts are stored in the form of film and printing plates are reproduced from the films picked out among the stored ones in answer to requests, it can be expected that the development of bulk recording media such as an optical disc enables those originals to be stored as digital data in such recording media.

However, there are few, if any, practically usable direct type printing plates, or printing plates produced directly from the output of a terminal plotter. Even in the case that the electronic editing system is working, therefore, it is the present situation that a printing plate is produced by the method comprising the steps of recording the output on a silver salt photographic film, bringing the resulting film into contact with a presensitized plate (PS plate) and then performing an exposure operation. One reason for adoption of this method is that there have been difficulties in developing presensitized plates which have sensitivities sufficient for the production of direct type printing plates within a practical time by the use of the light source of an output plotter (e.g., He—Ne laser, semiconductor laser).

As a photosensitive material having high photosensitivity enough to provide a direct type printing plate, an electrophotographic photoreceptor can be thought of. Specific examples of an electrophotographic photoreceptor include those disclosed in JP-B-37-17162 (the term "JP-B" as used herein means an "examined Japanese patent publication"), JP-B-38-6961, JP-B-38-7758, JP-B-41-2426, JP-B-46-39405, JP-A-50-19509 (the term "JP-A" as used herein means an "unexamined published Japanese patent application"), JP-A-50-19510, JP-A-52-2437, JP-A-54-145538, JP-A-54-134632, JP-A-55-105254, JP-A-55-153948, JP-A-55-161250, JP-A-57-147656 and JP-A-57-161863.

As a method of producing a printing plate by the use of electrophotography, there is already known the method in which the non-image area of a photoconductive layer is removed after the toner-image formation.

In the foregoing method, a binder resin of the kind which can be eliminated through dissolution or swelling in an alkaline solvent is used as the binder resin of an electrophotographic photoreceptor, and the area free from toner images is eluted using the toner images as resist to result in exposure of the water receptive face, thereby producing a lithographic printing plate.

However, printed matter obtained with the thus produced lithographic printing plate sometimes suffers scumming, namely gets ink on the non-image area. The scumming is presumed to arise from incomplete removal of the photosensitive layer from the water receptive substrate by elution. The lithographic printing plate using an electrophotographic photoreceptor stored for long time has more serious scumming problem. As a cause of the aggravation of scumming, it can be thought that a binding resin used in the photoreceptor comes to have an increased adhesiveness to the water receptive substrate (conductive support) by the influence of water or the like to result in more incomplete removal of the photoreceptive layer in the non-image area from the water receptive substrate in the elution process. The scumming can be prevented by increasing the solubility of the elute. Therein, however, the elution proceeds also in the horizontal direction of the image area (side etching) to deteriorate the image quality.

With the intention of solving the above problem, it has been tried to increase the acid content in a binder resin. While increase of the acid content in a binder resin can bring about an improvement in eluting properties, it involves problems from a practical point of view. That is, it not only produces an adverse effect on the scumming because the adhesiveness to a water receptive substrate is built up through long-term storage but also deteriorates electrophotographic characteristics, particularly charge accepting and charge-retaining characteristics.

SUMMARY OF THE INVENTION

Therefore, an object of the present invention is to obtain printed matter having no scum in the non-image area when a printing plate of the type which is produced in an electrophotographic process and has on a conductive support a photoconductive layer left imagewise by forming a toner image on the photoconductive layer and then removing the part on which the toner image is not formed.

Another object of the present invention is to provide an electrophotographic printing plate precursor having excellent image characteristics.

Still another object of the present invention is to provide an electrophotographic printing plate precursor having a high elution speed.

A further object of the present invention is to provide an electrophotographic printing plate precursor which does not cause scumming even when the printing plate precursor is stored for a long-term.

As a result of our intensive studies for solving the above-described problems, the objects of the present invention has been achieved by an electrophotographic printing plate precursor for a printing plate which is formed by forming a toner image on a photoconductive layer of an electrophotographic photoreceptor comprising at least a conductive support and a photoconductive layer and then by removing a non-image area on the photoconductive layer other than a toner-image area, wherein said photoconductive layer comprises at least (1) an organic photoconductive compound, (2) a binder resin which can be dissolved or swelled in an alkaline solution and (3) phosphoric acid or an analogue thereof.

DETAILED DESCRIPTION OF THE INVENTION

Phosphoric acid and an analogue thereof which can be used in the present invention (the additive of the present invention) can prevent the adhesiveness between a conductive support and a binder resin due to influence of moisture or the like during a long period of storage, and so can completely remove the non-image area of photosensitive layer from the water receptive substrate. Thus, the present invention can provide excellently printed matter which is free from scum in the non-image area.

The excessive increase in adhesiveness between a binder resin and a conductive support due to moisture is probably attributable to acidic groups which are introduced in a binder resin for improving eluting properties and electrophotographic characteristics. Accordingly, the phosphoric acid or its analogues of the present invention are presumed to control the interaction between a binder resin and a conductive support.

A great number of compounds which are well-known as organic photoconductive compounds can be used in the present invention.

Suitable examples of an organic photoconductive compound which can be used in the present invention include:

(a) the triazole derivatives as described in U.S. Pat. No. 3,112,197;

(b) the oxadiazole derivatives as described in U.S. Pat. No. 3,189,447;

(c) the imidazole derivatives as described in JP-B-37-16096;

(d) the polyarylalkane derivatives as described in U.S. Pat. Nos. 3,615,402, 3,820,989 and 3,542,544, JP-B-45-555, JP-B-51-10983, JP-A-51-93224, JP-A-55-108667, JP-A-55-156953, JP-A-56-36656;

(e) the pyrazoline derivatives and the pyrazolone derivatives as described in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637 and JP-A-55-74546;

(f) the phenylenediamine derivatives as described in U.S. Pat. No. 3,615,404, JP-B-51-10105, JP-B-46-3712, JP-B-47-28336, JP-A-54-83435, JP-A-54-110835 and JP-A-54-119925;

(g) the arylamine derivatives as described in U.S. Pat. Nos. 3,567,450, 3,180,703, 3,240,597, 3,658,520, 4,232,103, 4,175,961 and 4,012,376, West German Patent (DAS) 1,110,518, JP-B-49-35702, JP-B-39-27577, JP-A-55-144250, JP-A-56-119132 and JP-A-56-22437;

(h) the amino-substituted chalcone derivatives as described in U.S. Pat. No. 3,526,501;

(i) the N,N-bicarbazyl derivatives as described in U.S. Pat. No. 3,542,546;

(j) the oxazole derivatives as described in U.S. Pat. No. 3,257,203;

(k) the styrylanthracene derivatives as described in JP-A-56-46234;

(l) the fluorenone derivatives as described in JP-A-54-110837;

(m) the hydrazone derivatives as described in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749 and JP-A-57-104144;

(n) the benzidine derivatives as described in U.S. Pat. Nos. 4,047,948, 4,047,949, 4,265,990, 4,273,846, 4,299,897 and 4,306,008;

(o) the stilbene derivatives as described in JP-A-58-190953, JP-A-59-95540, JP-A-59-97148, JP-A-59-195658 and JP-A-62-36674;

(p) the polyvinylcarbazole and its derivatives as described in JP-B-34-10966;

(q) the vinyl polymers as described in JP-B-43-18674 and JP-B-43-19192, such as polyvinylpyrene, polyvinylanthracene, poly-2-vinyl-4-(4'-dimethylaminophenyl)-5-phenyloxazole, poly-3-vinyl-N-ethylcarbazole, etc.;

(s) the polymers as described in JP-B-43-19193, such as polyacenaphthylene, polyindene, acenaphthylene-styrene copolymer, etc.;

(t) the condensed resins as described in JP-B-56-13940, such as pyrene-formaldehyde resin, bromopyrene-formaldehyde resin, ethylcarbazole-formaldehyde resin, etc.; and (u) the various types of triphenylmethane polymers as described in JP-A-56-90883 and JP-A-56-161550.

Additionally, the present invention should not be construed as being limited to the compounds set forth above, from (a) to (u), but any of well-known organic photoconductive compounds may be usedin the present invention. Those organic photoconductive compounds can be used as a mixture of two or more thereof, if desired.

A photoconductive layer of the first type can contain sensitizing dyes which are known to have so far been used in an electrophotographic photoreceptor. Such sensitizing dyes are described in *Electrophotography*, volume 12, page 9 (1973) and *Yuki Gosei Kagaku Kyokai-Shi* (which means "Journal of Organic Synthesis Chemistry), 24(11), 1010 (1966). For instance, the pyrylium dyes as described in U.S. Pat. Nos. 3,141,770 and 4,283,475, JP-B-48-25658 and JP-A-62-71965, the triarylmethane dyes as described in *Applied Optics Supplement*, volume 3, 50 (1969) and JP-A-50-39548, the cyanine dyes as described in U.S. Pat. No. 3,597,196 and the styryl dyes as described in JP-A-60-163047, JP-A-59-164588 and JP-A-60-252517 can be used to advantage.

As the charge generating agent contained in a photoconductive layer of the second type, various organic and inorganic compounds which have so far been well-known as a charge generating agent can be used. For instance, there can be employed selenium, selenium-tellurium, cadmium sulfide, zinc oxide and the organic pigments including the azo pigments (1) and the phthalocyanine dyes (2) as set forth below:

(1) the azo pigments, such as monoazo pigments, bisazo pigments and trisazo pigments, described, e.g., in U.S. Pat. Nos. 4,436,800 and 4,439,506 and JP-A-47-37543, JP-A-58-123541, JP-A-58-192042, JP-A-58-219263, JP-A-59-78356, JP-A-60-179746, JP-A-61-148453, JP-A-61-238063, JP-B-60-5941 and JP-B-60-45664

(2) all well-known phthalocyanine pigments, which are different from one another in central metal, crystal form or/and have substituents to their benzene rings; with specific examples including metal-free phthalocyanines and those containing as their respective central atoms copper, nickel, iron, vanadium, aluminum, gallium, indium, silicon, titanium, magnesium, cobalt, platinum, germanium and so on. As the crystal form, a copper phthalocyanine may have any of α-form, β-form, γ-form, δ-form, ε-form, η-form, ρ-form and so on, a metal-free phthalocyanine may have any of α-form, β-form, χ-form, τ-form and so on, and titanyl phthalocyanine may have any of α-form, β-form and m-form. As the substituted phthalocyanines, their benzene rings may be substituted with any of halogen atoms such as fluorine, chlorine, bromine, etc., alkyl groups, carboxyl groups, amido groups, sulfonyl groups and so on. JP-A-50-38543 discloses ε-form copper phthalocyanines, and JP-B-48-34189 discloses χ-form phthalocyanines.

The above-described materials can be used alone or as a mixture of two or more thereof.

When a charge generating agent having not only a charge generating ability but also a charge transporting ability is used as a basic material, a photoreceptor can be prepared by dispersing the charge generating agent into a binder and then coating it. That is, it is not always required of such a charge generating agent to be used in combination with an organic photoconductive compound known as a charge transporting agent.

Further, the photoconductive layer can be a single layer or a plurality of layers integrated into a unit.

A binder resin used in the present electrophotographic printing plate precursor may be any resin, so far as it can ensure the removal of the non-image area with an eluting solution as described below after the toner development, and so it does not have any other particular limitations.

For instance, there can be exemplified as a binder resin which can be used in the present invention typical examples including a styrene/maleic anhydride copolymer; a styrene/maleic anhydride monoalkyl ester copolymer; a (meth-)acrylic acid/(meth)acrylate copolymer; a styrene/(meth-)acrylic acid/(meth)acrylate copolymer; a vinyl acetate/crotonic acid copolymer; a vinyl acetate/crotonic acid/(meth)acrylate copolymer; a copolymer of vinyl acetate/vinyl ester of carboxylic acid with 2 to 18 carbon atoms/carboxylic acid- or acid anhydride group-containing monomer of (meth)acrylate of crotonic acid, styrene or vinyl acetate and (meth)acrylic acid, itaconic acid, crotonic acid, maleic acid, maleic anhydride, maleic anhydride monoalkyl ester or fumaric acid; a copolymer containing a monomer having (meth)acrylamide, vinyl pyrrolidone, a phenolic hydroxy group, a sulfonic acid group, a sulfonamide group, a sulfonimide group or the like; a novolak resin prepared by condensation of phenol, o-cresol, m-cresol or p-cresol and formaldehyde or acetaldehyde; a partially saponified vinyl acetate resin; a polyvinyl acetal resin such as polyvinyl butyral, etc.; a urethane resin containing carboxylic acid groups.

Of these binder resins, the copolymers prepared from an ester of (meth)acrylic acid, styrene or vinyl acetate and a monomer containing carboxylic group(s) such as (meth-)acrylic acid, or a monomer containing an acid anhydride group are used to great advantage because they have excellent electrophotographic characteristics, eluting properties and printability.

More preferably, the copolymers of (meth)acrylic acid, a (meth)acrylic acid ester and an aliphatic or aromatic alcohol such as methyl alcohol, ethyl alcohol, propyl alcohol, isopropyl alcohol, butyl alcohol, isobutyl alcohol, sec-butyl alcohol, tert-butyl alcohol, n-amyl alcohol, isoamyl alcohol, hexyl alcohol, octyl alcohol, benzyl alcohol and phenetyl alcohol can be employed.

As the additive (phosphoric acid or an analogue thereof) used in the present invention, various well-known phosphoric acids and analogues thereof can be used, with specific examples including phosphoric acid, monoalkyl phosphates such as monoethyl phosphate, dialkyl phosphates such as diethyl phosphate, trialkyl phosphates such as triethyl phosphate, primary phosphates such as sodium dihydrogen phosphate, secondary phosphates such as disodium hydrogen phosphate, phosphonic acid, phosphonic acid esters such as dimethyl phosphonate, phosphonic acid salts such as sodium phosphonic acid salt, phosphinic acid, phosphinic acid salts such as sodium phosphinic acid salt, polyphosphoric acids represented by formula $H_{n+2}P_nO_{3n+1}$ (n=1–5), polyphosphates represented by formula $M_{n+2}P_nO_{3+1}$ (n=1–3), diphosphonic acid, diphosphonic acid salts such as sodium diphosphonic acid salt, metaphosphoric acids represented by formula $(HPO_3)_n$, metaphosphates represented by formulae $MPO_3$, $M^2(PO_3)_2$ and $M^3(PO_3)_3$ respectively, and so on. These compounds can be used alone or as a mixture of two or more thereof. For example, M is an alkali metal such as K and Na, $M^2$ is a metal such as Cu and Zn, and $M^3$ is a metal such as Cr and Ti.

As the conductive support used in the present electrophotographic printing plate precursor, a wide variety of supports can be employed.

Specific examples of such a support include a plastic sheet having a conductive surface; a special paper sheet which is rendered conductive and impervious to solvents; and conductive base plates having a water receptive surface, such as an aluminum plate, a zinc plate, bimetal plates including a copper-aluminum plate, a copper-stainless steel plate, a chromium-copper plate and so on, and trimetal plates including a chromium-copper-aluminum plate, a chromium-lead-iron plate, a chromium-copper-stainless steel plate and so on. It is preferred that such the conductive support as described above has a thickness of from 0.1 to 3 mm, particularly from 0.1 to 0.5 mm. Of these base plates, an aluminum plate is favored over the others because it has high dimensional stability.

An aluminum plate which can be used for the present electrophotographic printing plate precursor is a plate-form pure aluminum, a plate-form aluminum alloy containing a trace amount of foreign atoms, or the like. It has no particular restriction as to its composition, but any of well-known, generally used materials may be employed properly.

In using an aluminum plate as described above, it may undergo conventional graining and anodic oxidation treatments. Prior to the graining treatment, the aluminum plate is optionally subjected to a degreasing treatment with a surfactant or an alkaline aqueous solution in order to remove a rolling oil from the surface of the aluminum plate. As the graining treatment, it can be effected by adopting a method of mechanically roughening (i.e., graining) the surface, a method of electrochemically dissolving the surface or a method of performing selective dissolution of the surface with a chemical means. As the method of mechanically roughening the surface, known methods as called a ball abrasion method, a brush abrasion method, a blast abrasion method, a buff abrasion method and so on can be adopted. As the method of electrochemically roughening the surface, there is a method of soaking an aluminum plate in a hydrochloric or nitric acid electrolyte and passing therethrough a direct or alternating electric current to render the plate surface rough. In addition, the both the above-cited mechanically and electrochemically roughening methods may be used in combination, as disclosed in JP-A-54-63902.

The thus roughened aluminum plate may undergo an alkali etching treatment and a neutralizing treatment, if desired.

The aluminum plate which has undergo the treatments as described above is subjected to anodic oxidation. Suitable examples of an electrolyte used in the anodic oxidation include sulfuric acid, phosphoric acid, oxalic acid, chromic acid and a mixture of two or more thereof. The species and the concentration of an electrolyte to be used therein can be properly chosen. Further, the condition of the anodic oxidation can be changed variously depending on the electrolyte used, and so it is impossible to absolutely specify the condition. In general, however, effective anodic oxidation can be achieved so far as the concentration of an electrolytic solution used is in the range of 1 to 80% by weight, the solution temperature is in the range of 5° to 70° C., the electric current density is in the range of 5 to 60 A/dm$^2$, the voltage is in the range of 1 to 100 V, the electrolysis time is in the range of 10 seconds to 50 minutes. The coverage of the anodically oxidized film (i.e., an anodized film) is preferably in the range of 0.1 to 10 g/m$^2$, and more preferably in the range of 1 to g/m$^2$. Further, it is preferred that such the aluminum plate as described above has a thickness ranging from 0.1 to 3 mm, especially from 0.1 to 0.5 mm.

On the other hand, the aluminum plate as disclosed in JP-B-47-5125, which has been soaked in an aqueous solution of alkali metal silicate after the anodic oxidation, can be used to advantage. In addition, the electrodeposition of silicate as disclosed in U.S. Pat. No. 3,658,662 is effective and the treatment with polyvinylsulfonic acid as disclosed in West German Patent Application (OLS) No. 1,621,478 is also suitable for the surface treatment.

The present electrophotographic printing plate precursor can be obtained by coating a photoconductive layer on the aluminum base plate. The photoconductive layer may be made using any of known methods. For instance, the method of incorporating all the constituents of the photoconductive layer into the same layer and the method of using a charge carrier generating material and a charge carrier transporting material separately in different layers can be adopted.

In preparing a coating composition for the photoconductive layer, each ingredient to constituting the photoconductive layer is dissolved in an appropriate solvent. In case of ingredients insoluble in solvents, such as a pigment, they are dispersed to fine grains having a diameter of 5 μm or less by means of a disperser, e.g., a ball mill, a paint shaker, a dyno mill, an attriter or the like. A binder resin and other additives used for the photoconductive layer can be added simultaneously with or subsequently to the dispersion of the pigment and the like. The thus prepared coating composition is coated on the base plate using a known method such as spin coating, blade coating, knife coating, reverse roll coating, dip coating, rod bar coating, spray coating or so on, and then dried to prepare an electrophotographic printing plate precursor.

Specific examples of a solvent which can be used for preparing the coating composition include halogenated hydrocarbons such as dichloromethane, dichloroethane, chloroform, etc.; alcohols such as methanol, ethanol, etc.; ketones such as acetone, methyl ethyl ketone, cyclohexanone, etc.; propylene glycols such as propylene glycol monomethyl ether, propylene glycol monomethyl ether acetate, etc.; ethers such as tetrahydrofuran, dioxane, etc.; and esters such as ethyl acetate, butyl acetate, etc.

fin addition to an organic photoconductive compound and a binder resin as described above, a surfactant, a matting agent and other various kinds of additives may optionally be added to a coating composition for the present photoconductive layer for improving the surface condition of the photoconductive layer coated; provided that they do not deteriorate electrostatic characteristics and eluting properties of the resulting photoconductive layer.

As the thickness of the present photoconductive layer, a too thin photoconductive layer fails to have charge acceptance sufficient for development and, on the other hand, a too thick photoconductive layer tends to suffer a side etching phenomenon. Accordingly, any satisfactory printing plate cannot be obtained under those conditions. Thus, it is desirable that the photoconductive layer have a thickness ranging from 0.1 to 30 μm, preferably 0.5 to 10 μm.

As the contents of a binding resin and a photoconductive compound in the present photoconductive layer, in view of the fact that the photosensitivity becomes lower the lower the content of photoconductive compound is, it is preferred that the photoconductive compound is used in an amount of preferably from 0.025 to 1.5 parts by weight, more preferably from 0.05 to 1.2 parts by weight, and most preferably from 0.1 to 1 part by weight, per one part by weight of the binder resin.

As the amount of the present additive (phosphoric acid/an analogue thereof) added, the addition in a too large amount poses a problem such as the additive separates from the photoconductive layer, while the addition in a too small amount fails to achieve the objects of the present invention. Therefore, it is desirable that the present additive (phosphoric acid/an analogue thereof) be added in an amount of preferably from 0.00025 to 3 parts by weight, more preferably from 0.0005 to 2 parts by weight, and most preferably from 0.001 to 1 part by weight, per 10 parts by weight of the photoconductive layer.

In the electrophotographic printing plate precursor of the present invention, an interlayer can be provided, if desired, for improving the adhesiveness between the foregoing aluminum base plate and the photoconductive layer, the electric characteristics, eluting properties and printing characteristics of the photoconductive layer, and so on.

Specific examples of a compound suitable for the interlayer include casein, polyvinyl alcohol, ethyl cellulose, phenol resins, styrene-maleic anhydride resins, polyacrylic acid, monoethanolamine, diethanolamine, triethanolamine, tripropanolamine, the hydrochlorides, oxalates and phosphates of the amines described above, aminoacetic acid, monoaminomonocarboxylic acids such as alanine, etc., serine, threonine, oxyamino acids such as dihydroxyethylglycine, etc., sulfur-containing amino acids such as cysteine, cystine, etc., monoaminodicarboxylic acids such as aspartic acid, glutamic acid, etc., diaminomonocarboxylic acids such as lysine, etc., aromatic nucleus-containing amino acids such as p-hydroxyphenylglycine, phenylalanine, anthranyl acid, etc., hetero ring-containing amino acids such as tryptophan, proline, etc., aliphatic aminosulfonic acids such as sulfamic acid, cyclohexylsulfamic acid, etc., polyaminopolyacetic acids such as ethylenediaminetetraacetic acid, nitrilotriacetic acid, iminodiacetic acid, hydroxyethyliminodiacetic acid, hydroxyethylethylenediaminetriacetic acid, ethylenediaminediacetic acid, cyclohexanediaminetetraacetic acid, diethylenetriaminepentaacetic acid, glycol ether diamine tetraacetic acid, etc., and the sodium, potassium or ammonium salts of these polyaminopolyacetic acids wherein the salt formation may be a part or all of the acid groups.

Further, a topcoat layer removable upon the etching of the photoconductive layer can be provided on the photoconductive layer, if needed, for the purpose of improvement on the electric characteristics of the photoconductive layer, image characteristics in toner development and adhesiveness to toner. This topcoat layer may be a mechanically matted layer or a resin layer containing a matting agent. Suitable examples of a matting agent which can be used include silicon dioxide, zinc oxide, titanium oxide, zirconium oxide, glass particles, alumina, starch, resin particles (e.g., particles of polymethylmethacrylate, polystyrene, a phenol resin or so on) and the matting agents disclosed in U.S. Pat. Nos. 2,710,245 and 2,992,101. These matting agents can be used as a mixture of two or more thereof. A resin used for the matting agent-containing resin layer can be properly chosen depending on type of eluting solution used in combination therewith. Specific examples of such a resin include gum arabic, glue, gelatin, casein, celluloses (such as viscose, methyl cellulose, ethyl cellulose, hydroxyethyl cellulose, hydroxypropylmethyl cellulose, carboxymethyl cellulose, etc.), starches (such as soluble starch, denatured starch, etc.), polyvinyl alcohol, polyethylene oxide, polyacrylic acid, polyacrylamide, polyvinyl methyl ether, epoxy resins, phenol resins (preferably novolak type epoxy resins), polyamide and polyvinyl butyral. Two or more of these resins can be used in combination.

The toner for forming the image area in the present invention is not particularly limited as far as it has a resist property to an eluting solution as described hereinafter, but it preferably contains a resinous component having a resist property to the eluting solution.

Specific examples of such a resinous component include acrylic resins using methacrylic acid, acrylic acid and esters thereof; vinyl acetate resins; copolymer resins containing as constituent monomers vinyl acetate and ethylene or vinyl chloride; vinyl chloride resins; vinylidene chloride resins; vinyl acetal resins such as polyvinyl butyral; polystyrenes; copolymer resins containing as constituent monomers styrene. and butadiene, methacrylate; polyethylenes, polypropylenes and chlorinated products thereof, polyester resins (e.g., polyethylene terephthalate, polyethylene isophthalate, polycarbonate of bisphenol A); phenol resins; xylene resins; alkyd resins; vinyl-modified alkyd resins; gelatin; cellulose ester derivatives such as carboxymethyl cellulose, etc.; wax; polyolefins and so on.

The eluting solution, which is used for removing the non-image area of photoconductive insulation layer after the formation of toner image, may be any solvent as far as the solvent can remove the photoconductive insulation layer. Although it has no particular limitation, the elution solution used herein is preferably an alkaline solvent. The term "alkaline solvent" is intended to include an aqueous solution containing an alkaline compound, an organic solvent containing an alkaline compound and a mixture of an alkaline compound-containing aqueous solution with an organic solvent.

The alkaline compound contained therein may be any of organic and inorganic alkaline compounds, with specific examples including sodium hydroxide, potassium hydroxide, sodium carbonate, sodium silicate, potassium silicate, sodium metasilicate, potassium metasilicate, sodium phosphate, potassium phosphate, ammonia and aminoalcohols such as monoethanolamine, diethanolamine, triethanolamine, etc. As for the solvent of an eluting solution, as described above, water and many kinds of organic solvents can be used. However, it is favorable to use an eluting solution containing water as a main solvent in view of odor and pollution problems.

Also, it is possible to add various kinds of organic solvent to the eluting solution containing water as a main solvent, if desired. Suitable examples of such an organic solvent include lower alcohols and aromatic alcohols, such as methanol, ethanol, propanol, butanol, benzyl alcohol, phenetyl alcohol, etc., ethylene glycol, diethylene glycol, triethylene glycol, polyethylene glycol, cellosolves and so on.

Further, the eluting solution can contain a surfactant, an antifoaming agent and other various kinds of additives, if needed.

In the electrophotographic printing plate precursor according to the present invention, generally known processes are applicable.

More specifically, substantially uniform charging is carried out in the dark, and then an electrostatic latent image is formed by imagewise exposure.

As the way of exposure, scanning exposure using a semiconductor laser, He—Ne laser or the like, reflex type imagewise exposure using a xenon lamp, a tungsten lamp, a fluorescent lamp or the like as light source, and the contact exposure via a transparent positive film are illustrated.

Further, the foregoing electrostatic latent image is developed with toner. The development herein can be performed using various conventional methods, including cascade development, magnetic brush development, powder cloud development, liquid development and so on. Of these methods, liquid development is particularly suitable for the production of a printing plate because it enables the formation of fine images. On the other hand, each development has two forms, namely a positive development form in which toner adheres to the non-exposure area and a reversal development form in which toner adheres to the exposure area, and it is possible to adopt either form. The toner image formed is fixed by a conventional method, for example, heat fixation, pressure fixation, solvent fixation or so on. The thus fixed toner image functions as a resist in an etching step to come next. Thus, the photoconductive layer is removed with an eluting solution in the non-image area alone, thereby enabling the production of a printing plate.

The present invention will now be illustrated in more detail by reference to the following examples, but it should not be construed as being limited to these examples as far as various changes and modifications introduced thereto were within the spirit and scope of the invention.

Examples 1–12 and Comparative Examples 1–2 were performed, and the evaluation results thereof are summarized in Table 1 shown hereinafter.

EXAMPLE 1

The surface of an aluminum sheet (JIS1050) was grained using a rotated nylon brush and a pumice-water suspension as abrasive. The surface roughness (center-line-average roughness) of the thus grained surface was 0.5 μm. After washing, the aluminum sheet was soaked in a 10% aqueous solution of sodium hydroxide at 70° C. and etched so that the amount of aluminum dissolved was 6 g/m$^2$. After washing, the etched surface was neutralized by dipping the aluminum sheet in a 30% aqueous solution of nitric acid for 1 minute, and thoroughly rinsed. Thereafter, the sheet was subjected to an electrolytic surface-graining treatment which was carried out for 20 seconds using rectangular alternating waves having the anode voltage of 13 volt and the cathode voltage of 6 volt in a 0.7% aqueous solution of nitric acid (as disclosed in JP-B-55-19191), and then the surface of the sheet was cleaned by dipping it in a 20% aqueous solution of sulfuric acid at 50° C., followed by rinsing with water. Further, the resulting sheet was subjected to an anodic oxidation treatment in a 20% aqueous solution of sulfuric acid so that the weight of the anodically oxidized film was 3.0 g/m$^2$, and then washed and dried to prepare a base plate.

On the thus prepared base plate, the following coating composition (1) for a photoconductive layer was coated with a bar coater, and dried for 10 minutes at 120° C. to prepare an electrophotographic printing plate.

The thus prepared plate had a dry thickness of 5 g/m$^2$.

Coating Composition (1) for Photoconductive Layer:

| | |
|---|---|
| χ-type Metal-free Phthalocyanine Compound | 1.0 part by weight |

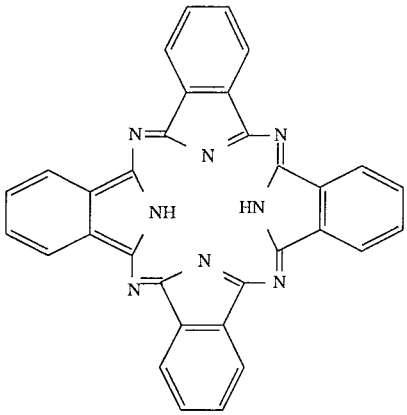

| | |
|---|---|
| Benzylmethacrylate-Methacrylic Acid Copolymer (methacrylic acid: 40 mole %) | 9.0 parts by weight |
| Phosphoric Acid | 0.005 part by weight |
| Methyl Ethyl Ketone | 40 parts by weight |
| Propylene Glycol Monomethyl Ether | 60 parts by weight |

The above-described composition was placed together with glass beads in a 500 ml glass container, and dispersed for 60 minutes with a paint shaker (made by Toyo Seiki Seisakusho Co., Ltd.) to prepare a dispersion for the photoconductive layer.

This electrophotographic photoreceptor was placed in a thermohygrostat ("Thermoceluco Platinous Rainbow PR-2G" made by TABAI ESPEC Corp.), and allowed to stand for 3 days under the condition of 50° C. and 80% RH.

Next, this sample was charged in the dark by means of a corona charging device so as to have the surface potential of +400 V, exposed to tungsten light via a negative image, and then subjected to reversal development. In the reversal development, there was used a liquid developer prepared by dispersing 5 g of polymethylmethacrylate particles (particle size: 0.3 μm) as toner particles into 1 liter of Isoper H (products of Esso Standard Co., Ltd.) and adding thereto 0.01 g of zirconium naphthate as a charge controlling agent, and +300 V of bias voltage was applied to the counter electrode. Thus, a clear positive image was obtained. Further, the thus formed image was heated at 120° C. for 2 minutes to fix the toner image. Removal of the non-image area was tried with an eluting solution in which 35 parts by weight potassium silicate, 15 parts by weight of potassium hydroxide, 10 parts by weight of benzyl alcohol and 10 parts by weight of monoethanolamine were diluted with 690 parts by weight of water. As a result, the non-image area was rapidly eluted. Then, the sample was thoroughly washed, and coated with a gum solution ("Gum GU-7 for PS plate", produced by Fuji Photo Film Co., Ltd.) to produce an offset printing plate.

No residue was observed in the non-image area of Chis printing plate. The printing plate was set in an offset printing machine, and the printing operation was performed. The prints obtained were free from scum and had good quality.

Comparative Example 1

A printing plate was produced in the same manner as in Example 1, except that phosphoric acid was not used at all.

After the elution, a blue residue was left in the non-image area of the printing plate precursor, and the scum was generated in the non-image part after the printing operation.

Comparative Example 2

A printing plate was produced in the same manner as in Example 1, except that phosphoric acid was not used, the binder resin was changed to 9.0 parts by weight of the benzylmethacrylate-methacrylic acid copolymer (methacrylic acid: 50 mole %) and the composition of the eluting solution was changed to one which contained 30 parts by weight of potassium silicate, 10 parts by weight of potassium hydroxide, 7 parts by weight of benzyl alcohol, 7 parts by weight of monoethanolamine and 706 parts by weight of water.

After the elution, a blue residue was left in the non-image area of this printing plate precursor also, and the scum was generated in the non-image area after the printing operation.

EXAMPLE 2

A printing plate was produced in the same manner as in Example 1, except that the phosphoric acid concentration was changed to 0.01 part by weight.

No residue was observed in the non-image area of this printing plate precursor after the elution, and the prints obtained had no scum and good quality.

EXAMPLE 3

A printing plate was produced in the same manner as in Example 1, except that phosphonic acid was used in place of the phosphoric acid.

No residue was observed in the non-image area of this printing plate precursor after the elution, and the prints obtained had no scum and good quality.

EXAMPLE 4

A printing plate was produced in the same manner as in Example 1, except that sodium dihydrogen phosphate was used in place of the phosphoric acid.

No residue was observed in the non-image area of this printing plate precursor after the elution, and the prints obtained had no scum and good quality.

EXAMPLE 5

A printing plate was produced in the same manner as in Example 1, except that sodium hexametaphosphate was used in place of phosphoric acid and the concentration thereof was 0.1 part by weight.

No residue was observed in the non-image area of this printing plate precursor after the elution, and the prints obtained had no scum and good quality.

EXAMPLE 6

A printing plate was produced in the same manner as in Example 1, except that phosphinic acid was used in place of the phosphoric acid.

No residue was observed in the non-image area of this printing plate precursor after the elution, and the prints obtained had no scum and good quality.

EXAMPLE 7

A printing plate was produced in the same manner as in Example 1, except that polyphosphoric acid was used in place of phosphoric acid and the concentration thereof was 0.01 part by weight.

No residue was observed in the non-image area of this printing plate precursor after the elution, and the prints obtained had no scum and good quality.

EXAMPLE 8

A printing plate was produced in the same manner as in Example 1, except that sodium phosphonic acid salt was used in place of phosphoric acid and the concentration thereof was 0.01 part by weight.

No residue was observed in the non-image area of this printing plate precursor after the elution, and the prints obtained had no scum and good quality.

EXAMPLE 9

A printing plate was produced in the same manner as in Example 1, except that diphosphonic acid was used in place of phosphoric acid and the concentration thereof was 0.01 part by weight.

No residue was observed in the non-image area of this printing plate precursor after the elution, and the prints obtained had no scum and good quality.

EXAMPLE 10

A printing plate was produced in the same manner as in Example 1, except that metaphosphoric acid was used in place of phosphoric acid and the concentration thereof was 0.3 part by weight.

EXAMPLE 11

A printing plate was produced in the same manner as in Example 1, except that triethyl phosphonate was used in place of phosphoric acid and the concentration thereof was 0.05 part by weight.

EXAMPLE 12

On the same aluminum base plate as in Example, the following coating composition (2) for a photoconductive layer was coated with a bar coater, and dried for 10 minutes at 120° C. to produce an electrophotographic printing plate.

The thus produced printing plate had a dry coverage of 4 $g/m^2$.

| Coating Composition (2) for Photoconductive Layer: | |
|---|---|
| Trisazo Compound | 1.0 part by weight |

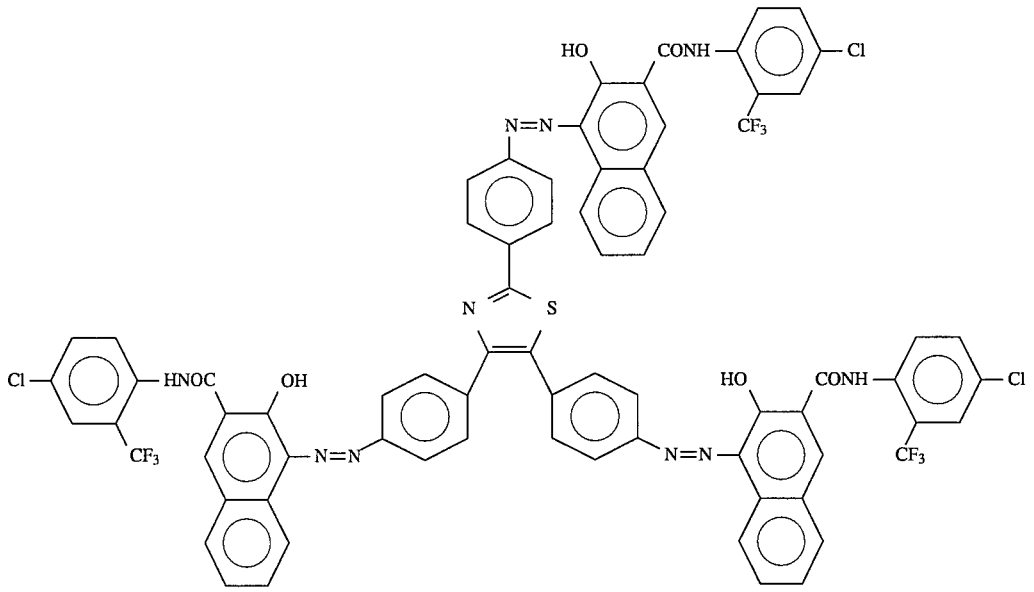

-continued

| Coating Composition (2) for Photoconductive Layer: | |
|---|---|
| Hydrazone Compound | 2.5 parts by weight |

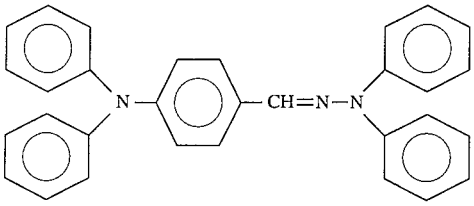

| | |
|---|---|
| Butylmethacrylate-Methacrylic Acid Copolymer (methacrylic acid: 30 mole %) | 10.0 parts by weight |
| Phosphoric Acid | 0.005 part by weight |
| Methyl Ethyl Ketone | 60 parts by weight |
| Propylene Glycol Monomethyl Ether | 40 parts by weight |

The above-described composition was placed together with glass beads in a 500 ml glass container, and dispersed for 60 minutes with a paint shaker (made by Toyo Seiki Seisakusho Co., Ltd.) to prepare a dispersion for the photoconductive layer.

After this electrophotographic photoreceptor was stored for 3 days under the condition of 50° C. and 80% RH in the same manner as in Example 1, it was subjected to toner development and then eluted with a solution prepared by diluting a developer for PS plate ("DP-4" produced by Fuji Photo Film Co., Ltd.), with water in a ratio of 1:8. The eluting properties of this photoconductive layer was almost the same as those of the photoconductive layer stored at room temperature. That is, the photoconductive layer stored under the high temperature-high humidity condition was readily eluted. Then, the printing plate sample was thoroughly washed, and coated with a gum solution ("Gum GU-7 for PS plate", produced by Fuji Photo Film Co., Ltd.) to be made into an offset printing plate.

The printing plate was set in an offset printing machine, and the printing operation was performed. The prints obtained were free from scum and had good quality.

TABLE 1

| Test No. | Binder Resin | Additive species | Additive amount | Scum | Charge retention | Fine line Reproduction |
|---|---|---|---|---|---|---|
| Comp. Ex. 1 | A | — | — | B | G | G |
| Comp. Ex. 2 | B | — | — | B | B | B |
| Ex. 1 | A | a | 0.005 | G | G | G |
| Ex. 2 | A | a | 0.01 | G | G | G |
| Ex. 3 | A | b | 0.005 | G | G | G |
| Ex. 4 | A | c | 0.005 | G | G | C |
| Ex. 5 | A | d | 0.1 | G | G | G |
| Ex. 6 | A | e | 0.05 | G | G | G |
| Ex. 7 | A | f | 0.05 | G | G | G |
| Ex. 8 | A | 9 | 0.01 | G | G | G |
| Ex. 9 | A | h | 0.01 | G | G | G |
| Ex. 10 | A | i | 0.3 | G | G | G |
| Ex. 11 | A | j | 0.5 | G | G | G |
| Ex. 12 | C | a | 0.05 | G | G | G |

[Binder Resin]

A. Benzylmethacrylate/methacrylic acid copolymer (methacrylic acid: 40 mole %)
B. Benzylmethacrylate/methacrylic acid copolymer (methacrylic acid: 50 mole %)
C. Butylmethacrylate/methacrylic acid copolymer (methacrylic acid: 30 mole %)

TABLE 1-continued

[Additive]

a. Phosphoric acid
b. Phosphonic acid
c. Sodium dihydrogen phosphate
d. Sodium hexametaphosphate
e. Phosphinic acid
f. Polyphosphoric acid
g. Sodium phosphonic acid salt
h. Diphosphonic acid
i. Metaphosphoric acid
j. Triethyl phosphonate

[Amount added]

It was expressed in parts by weight per 10 parts by weight of photoconductive layer.

[Scum]

The extent of scum on the prints was evaluated after allowed to stand for 1 hour.
G: no scum and good image qualities
B: so much scum as to be below the practical-use level

[Charge Retention]

Rate of charge retained in 30-second lapse after charging (which was measured with an electrostatic paper analyzer ("Model EPA-8100", made by Kawaguchi Denki Co., Ltd.)).
G: above 90%
B: below 70%

[Fine Line Reproduction]

G: success in reproducing fine lines less than 20 μm in line width
B: failure in reproducing fine lines having a line width of 20 μm As illustrated above, the electrophotographic printing plate precursors according to the present invention can retain their eluting properties even if they are stored for a long term when phosphoric acid or an analogue thereof (the present additive) is added to their respective photoconductive layers, and so the present additive-added printing plates can provide lithographic printing plates which are free from scumming in the non-image area even after long-range storage and have excellent image characteristics and a high elution speed.

While the invention has been described in detail and with reference to specific embodiments thereof, it will be apparent to one skilled in the art that various changes and modifications can be made therein without departing from the spirit and scope thereof.

What is claimed is:

1. An electrophotographic printing plate precursor comprising a conductive support and a photoconductive layer, said photoconductive layer comprising (1) an organic photoconductive compound, (2) a binder resin which is dissolved or swelled in an alkaline solution and (3) an additive selected from the group consisting of phosphoric acid, monoalkyl phosphates, dialkyl phosphates, trialkyl phosphates, primary phosphates, secondary phosphates, phosphonic acid, phosphonic acid salts, phosphinic acid, phosphinic acid salts, polyphosphoric acids represented by the formula $H_{n+2}P_nO_{3n+1}$ wherein n=1–5, polyphosphates represented by the formula $M_{n+2}P_nO_{3n+1}$ wherein M is an alkali metal and n=1–3, diphosphonic acid, diphosphonic acid salts, metaphosphoric acids, compounds represented by formulae $MPO_3$, $M^2(PO_3)_2$ and $M^3(PO_3)_3$ wherein M is an alkali metal, $M^2$ is a divalent metal and $M^3$ is a trivalent metal, and mixtures thereof wherein a toner image can be formed on the photoconductive layer and non-image area of the photoconductive layer can be removed by an alkaline solution.

2. The electrophotographic printing plate precursor of claim 1, wherein the organic photoconductive compound is used in an amount of from 0.025 to 1.5 parts by weight per one part by weight of the binder resin.

3. The electrophotographic printing plate precursor of claim 1, wherein the additive is used in an amount of from 0.00025 to 3 parts by weight per 10 parts by weight of the photoconductive layer.

* * * * *